US010721813B2

(12) United States Patent
Elfsberg

(10) Patent No.: US 10,721,813 B2
(45) Date of Patent: Jul. 21, 2020

(54) ARRANGEMENT AND PROCESS FOR THERMAL SPRAY COATING VEHICLE COMPONENTS WITH SOLID LUBRICANTS

(71) Applicant: Scania CV AB, Södertälje (SE)

(72) Inventor: Jessica Elfsberg, Tullinge (SE)

(73) Assignee: SCANIA CV AB (SE)

( * ) Notice: Subject to any disclaimer, the term of this patent is extended or adjusted under 35 U.S.C. 154(b) by 0 days.

(21) Appl. No.: 15/774,031

(22) PCT Filed: Oct. 19, 2016

(86) PCT No.: PCT/SE2016/051018
§ 371 (c)(1),
(2) Date: May 7, 2018

(87) PCT Pub. No.: WO2017/086857
PCT Pub. Date: May 26, 2017

(65) Prior Publication Data

US 2018/0359843 A1 Dec. 13, 2018

(30) Foreign Application Priority Data

Nov. 16, 2015 (SE) ..... 1551477

(51) Int. Cl.
*H05H 1/42* (2006.01)
*C23C 4/06* (2016.01)
(Continued)

(52) U.S. Cl.
CPC ..... *H05H 1/42* (2013.01); *B05B 7/18* (2013.01); *B05B 7/22* (2013.01); *C23C 4/06* (2013.01);
(Continued)

(58) Field of Classification Search
USPC ..... 118/302, 62, 63, 308
See application file for complete search history.

(56) References Cited

U.S. PATENT DOCUMENTS 3,020,182 A * 2/1962 Daniels ..... C23C 4/02 428/547
5,332,422 A 7/1994 Rao ..... 75/252
(Continued)

FOREIGN PATENT DOCUMENTS

DE 10 2004 055 199 A1 5/2006
EP 1 785 503 A2 5/2007
(Continued)

OTHER PUBLICATIONS

International Search Report dated Jan. 20, 2017 in corresponding PCT International Application No. PCT/SE2016/051018.
(Continued)

*Primary Examiner* — Yewebdar T Tadesse
(74) *Attorney, Agent, or Firm* — Ostrolenk Faber LLP

(57) ABSTRACT

An arrangement (40) and process for coating a vehicle component (30) with a solid lubricant including a thermal spray device (10) having a spray direction along a spray line (S) corresponding to a central axis of a spray plume (16); a solid lubricant injection device (20) having an injection direction along an injection line (L) corresponding to a central axis of an injection plume (24); and a vehicle component (30) to be coated, having a surface (31) arranged at a distance (d) from an outlet orifice (13) of the thermal spray device (10) along the spray line (S). The solid lubricant injection device (20) is positioned such that the injection line (L) intersects the spray line (S) at an intersection point (P), which is intermediate the outlet orifice (13) of the thermal spray device (10) and the surface (31) of the component (30) to be coated. Also a process for thermal spray coating a vehicle component (30) with a solid lubricant coating and a vehicle, with such a coated component.

12 Claims, 6 Drawing Sheets

(51) Int. Cl.

| | |
|---|---|
| ***B05B 7/18*** | (2006.01) |
| ***C23C 4/134*** | (2016.01) |
| ***B05B 7/22*** | (2006.01) |
| ***C23C 4/067*** | (2016.01) |
| *B05B 13/06* | (2006.01) |

(52) U.S. Cl.
CPC ..... *C23C 4/067* (2016.01); *C23C 4/134* (2016.01); *B05B 13/0627* (2013.01)

(56) References Cited

U.S. PATENT DOCUMENTS

| | | | | |
|---|---|---|---|---|
| 5,340,615 | A * | 8/1994 | Browning | B05D 1/10 427/426 |
| 5,766,690 | A | 6/1998 | Derby et al. | 427/450 |
| 2003/0201251 | A1 | 10/2003 | Barbezat et al. | 219/76.14 |
| 2007/0269151 | A1* | 11/2007 | Nardi | C23C 4/02 384/279 |
| 2008/0145554 | A1 | 6/2008 | Ghasripoor et al. | 427/450 |
| 2012/0180747 | A1 | 7/2012 | Domanchuk et al. | 123/193.6 |
| 2013/0183453 | A1* | 7/2013 | Heinrich | B05B 7/162 427/456 |

FOREIGN PATENT DOCUMENTS

| | | | |
|---|---|---|---|
| EP | 1 857 694 | A1 | 11/2007 |
| WO | WO 02/24970 | A2 | 3/2002 |
| WO | WO 2011/094222 | A1 | 8/2011 |

OTHER PUBLICATIONS

Written Opinion dated Jan. 20, 2017 in corresponding PCT International Application No. PCT/SE2016/051018.

I.A. Fisher, "Variables Influencing the Characteristics of Plasma-Sprayed Coatings," International Metallurgical Reviews, vol. 17, pp. 117-129, Jun. 1972.

* cited by examiner

ARRANGEMENT AND PROCESS FOR THERMAL SPRAY COATING VEHICLE COMPONENTS WITH SOLID LUBRICANTS

CROSS-REFERENCE TO RELATED APPLICATIONS

The present application is a 35 U.S.C. §§ 371 national phase conversion of PCT/SE2016/051018, filed Oct. 19, 2016, which claims priority of Swedish Patent Application No. 1551477-1, filed Nov. 16, 2015, the contents of which are incorporated by reference herein. The PCT International Application was published in the English language.

TECHNICAL FIELD

The present invention relates to an arrangement for coating vehicle components. The present invention also relates to a process for thermal spray coating of vehicle components with solid lubricants. Moreover, the present invention relates to an internal combustion engine comprising components obtained by the inventive process. Furthermore, the present invention relates to a vehicle comprising such an internal combustion engine.

BACKGROUND

The components of internal combustion engines are routinely subjected to harsh conditions during operation. The combustion of fuels leads to high temperatures, high pressures and a corrosive environment for many components, not least inside the combustion chamber. At the same time, the movement of reciprocating parts leads to wear and frictional losses in the engine. Heavy duty vehicle engines have, due to their size, typically been provided with loose cast iron liners. Also other vehicle components such as gears or synchronizers are subject to frictional wear.

Vehicle component parts such as cylinder liners can be coated using any of a number of methods, depending on the coating required, the coating thickness and the conditions that the component tolerates. Thermal spray coating methods are among the most commonly used.

Thermal spray coating involves propelling melted or molten spray material at high speed onto a cleaned and prepared component surface. Methods of thermal spray coating can be further subdivided and include flame spray coating, electric arc spray coating, high velocity oxy-fuel spray coating and plasma spray coating. All thermal spray methods are characterized by the high temperatures that the thermal-coating compositions are subjected to during the coating process, which can be from approximately 2600° C. to 16000° C. depending on the method used.

An existing production process for coating cylinder liners is the plasma spray coating of grey cast iron liners with a powder comprising stainless steel and alumina-zirconia composite. Such coatings greatly improve the cylinder properties with regards to wear and corrosion. Honing of the coated surface also provides good lubrication properties of the surfaces that liquid lubricants can reach. However, due to increasing demands for better fuel economy and lower emissions, there remains a desire to further reduce friction in the engine, especially at surfaces that may be poorly lubricated using liquid lubricant systems.

The component parts of a combustion engine are typically lubricated using an oil-based lubricant system. While such systems have been proven to be effective, sufficient lubrication is difficult to achieve in all operating conditions and at all areas of frictional contact. This is especially a problem for vehicles implementing stop/start drive systems, for example hybrid vehicles. Therefore, the use of solid lubricants is attracting interest.

Solid lubricants are materials which despite being in the solid phase are able to reduce friction between two surfaces sliding against each other without the need for a liquid lubricant medium. Common solid lubricants include graphite, molybdenum disulphide and boron nitride. Solid lubricants can be used to reduce friction in situations where the use of conventional liquid lubricants is insufficient or inappropriate. Such uses include interfaces in reciprocating engines and turbines, such as in the cylinder liners of an internal combustion engine.

A number of methods for the thermal spraying of solid lubricant coatings are known in the art.

In U.S. Pat. No. 5,332,422A a plasma sprayable powder for coating surfaces such as cylinder bores of an internal combustion engine is disclosed. The plasma sprayable powder comprises grain size agglomerates of i) a plurality of solid lubricant particles; ii) fusable ingredients adjacent the solid lubricant particles; and iii) a low melting medium binding the solid lubricant particles and fusible particles together in agglomerated grains.

In EP1785503A1 a coating with a low coefficient of friction that is wear resistant, corrosion resistant and heat resistant is disclosed. The coating is prepared by a process comprising the steps of: providing hard face material particles; agglomerating the hard face material particles using a first binder material; providing solid lubricant material particles; agglomerating the solid lubricant material particles using a second binder material; and applying to a substrate the agglomerated hard face material particles and the agglomerated solid lubricant material particles via a thermal spray process.

In US2008/0145554A1 a method of making a thermal spray powder is disclosed. The method comprises: providing a powder comprising a plurality of porous particles; infiltrating a mixture comprising a solvent and a plurality of solid lubricant particles into the porous particles; and heat-treating the powder to a temperature sufficient to evaporate the solvent.

In WO2011/094222A1 a thermal spray powder is disclosed. The thermal spray powder comprises a solid lubricant clad with at least one of a metal and metal alloy, mechanically blended with a metal or polymer clad with at least one of a number of specified metals or metal alloys.

In U.S. Pat. No. 5,766,690A a method of producing a self-lubricating coating on a substrate is disclosed. The method comprises the steps of: providing a matrix of particles including chromium carbide; mixing with the matrix a solid lubricant including barium fluoride and calcium fluoride particles to form a composite material; providing a high velocity oxy-fuel gas stream; and introducing the composite material into the gas stream to spray deposit the composite material onto the substrate.

There are a number of problems associated with these known methods. Many are based upon the principle of "encapsulating" or agglomerating the solid lubricant in order to avoid volatilization or decomposition. Manufacturing of such coating materials is complicated and expensive. If such an "encapsulated" solid lubricant is not used, the high temperatures used in thermal spray methods tend to volatilize or decompose the solid lubricant. This results in low incorporation of the solid lubricant into the final coating, manufacturing difficulties, production down-time and the loss of material since the final coating contains relatively little solid lubricant in relation to the amount used in the powder mixture. Moreover, the volatilized material risks being undesirably deposited on proximate surfaces if sufficient fume extraction is not obtained. Attempting to rectify these problems by reducing the temperature of the spray results in lower deposition efficiency of the other, less-volatile, constituents, such as ceramic particles and metal alloy particles. Using larger solid lubricant particles sizes or agglomerating the coating mixture can to some extent mitigate these problems, but instead leads to decreased anti-friction effects or a complex manufacturing procedure for the coating mixture.

There therefore exists a need for a method for producing a coating comprising solid lubricant that reduces or eliminates the problems associated with the methods known in the art.

SUMMARY OF THE INVENTION

The inventor of the present invention have realized that prior art methods for thermal spray coating with a solid lubricant require complicated manufacturing techniques for agglomerating or encapsulating the coating composition, and that only powdered materials can be used as coating materials. Moreover, the inventor has realized that the prior art methods suffer from the relatively high volatility of the solid lubricants, leading to low solid lubricant content in the final coating. The inventor has realized that these problems result in components with sub-optimal lubrication properties when coating vehicle components, such as internal combustion engine components. The inventor has further realized that this even causes problems with the dimensioning of coating fume extraction systems and/or with unwanted deposition of solid lubricant on proximate surfaces of the vehicle components.

Therefore, it is an object of the present invention to provide an arrangement and process for thermal spray coating vehicle components with solid lubricants that avoids or alleviates the shortcomings of the prior art.

It is an object of the present invention to provide an arrangement and process that enables the incorporation of higher proportions of solid lubricant into a coated vehicle component surface, without compromising the deposition efficiency of the process.

It is also an object of the present invention to provide an arrangement and system that avoids complicated manufacturing processes for the coating material.

It is also an object of the present invention to provide an arrangement and system that allows the use of non-powdered coating materials, for instance metallic wire, when thermal spray coating vehicle components with solid lubricants.

It is a further object of the present invention to provide an arrangement and system that allows for a smaller dimensioning of any fume extraction system in the coating arrangement.

It is also an object of the present invention to provide an arrangement and system that reduces the risk of unwanted deposition of solid lubricants on surfaces proximate to the surface to be coated of vehicle components.

It is also an object of the present invention to provide vehicle components coated with satisfactory quantities of solid lubricants, and therefore having satisfactory lubrication properties.

It is a further object of the invention to provide an internal combustion engine having lower frictional losses when in operation.

It is also an object of the present invention to provide a vehicle having lower frictional losses in its power system and therefore improved fuel economy.

The above-mentioned objects are achieved by an arrangement for coating a vehicle component according to the present invention, the arrangement comprising:

a) a thermal spray device comprising a process gas inlet, a thermal-coating composition inlet, and an outlet orifice, the thermal spray device having a spray direction along a spray line corresponding to a central axis of a spray plume, the spray line being aligned with a central axis line passing through a center of the outlet orifice of the thermal spray device;

b) a solid lubricant injection device comprising a fluidized solid lubricant inlet and an outlet orifice, the solid lubricant injection device having an injection direction along an injection line corresponding to a central axis of an injection plume, the injection line being aligned with a central axis line of the solid lubricant injection device; and c) a vehicle component to be coated, having a surface arranged at a distance d from the outlet orifice of the thermal spray device along the spray line.

The solid lubricant injection device is positioned such that the injection line intersects the spray line at an intersection point, which is intermediate the outlet orifice of the thermal spray device and the surface of the component to be coated. It has been realized that by positioning the solid lubricant injection device such that the injection line intersects the spray line at an intersection point, which is intermediate the outlet orifice of the thermal spray device and the surface of the component to be coated, the solid lubricant does not volatilize or decompose substantially before it reaches the target surface while the less-volatile constituents are deposited in a sufficient amount. Therefore, it is possible to incorporate higher proportions of solid lubricant into a coated vehicle component surface, without compromising the deposition efficiency of the process. This is especially advantageous when coating internal combustion engine components. By the present arrangement, also the other objectives mentioned may be attained.

According to one embodiment, the solid lubricant injection device is separate from the thermal spray device. This allows for a large flexibility in the choice of the intersection point and therefore allows for the largest possible relative variation between solid lubricant and thermal-coating composition properties.

According to another embodiment, the solid lubricant injection device is integrated with the thermal spray device. This allows for easy handling of the coating arrangement and for consolidation of system constituents such as pumps and gas tubes.

According to one feature, the intersection point of the injection line and spray line is at a distance of less than 0.75 d from the surface of the component to be coated and preferably less than 0.5 d from the surface of the component to be coated. This allows for the use of relatively volatile and/or decomposable solid lubricants. According to another feature, the injection line is aligned in respect of the spray line in the direction of injection and spraying at an interception angle $\alpha$ from about 90° to about 30°, preferably from about 90° to about 60°.

This allows the use of solid lubricants with a wide range of densities, boiling points and/or decomposition temperatures.

According to a further feature, the thermal spray device is a plasma spray device. This allows compatibility with pre-existing processes and coating compositions for the coating of vehicle components.

According to another aspect of the present invention, the above-mentioned objects are achieved by a process for thermal spray coating of a vehicle component with a solid lubricant coating, comprising the steps of:

i) providing a thermal spray device comprising a process gas inlet, a thermal-coating composition inlet, and an outlet orifice, the thermal spray device having a spray direction along a spray line corresponding to a central axis of a spray plume, the spray line being aligned with a central axis line passing through a center of the outlet orifice of the thermal spray device;

ii) providing a solid lubricant injection device, comprising a fluidized solid lubricant inlet and an outlet orifice, the solid lubricant injection device having an injection line corresponding to a central axis of an injection plume, the injection line being aligned with a central axis line of the solid lubricant injection device;

iii) providing a vehicle component to be coated;

iv) arranging the thermal spray device and the vehicle component such that the vehicle component has a surface at a distance d from the outlet orifice of the thermal spray device along the spray line;

v) positioning the solid lubricant injection device such that the injection line L intersects the spray line at an intersection point intermediate the outlet orifice of the thermal spray device and the surface of the component to be coated;

vi) feeding a process gas and a thermal-coating composition to the thermal spray device and operating the thermal spray device, thereby forming a coating spray plume that is propelled in a spray direction towards the surface of the component to be coated, the coating spray plume comprising process gas and at least partially molten thermal-coating composition;

vii) feeding a fluidized solid lubricant composition to the solid lubricant injection device and operating the solid lubricant injection device, thereby injecting a solid lubricant composition in an injection direction into the coating spray plume.

According to one feature, the intersection point P of the lines L and C is at a distance of less than 0.75 d from the surface of the component to be coated, preferably less than 0.5 d from the surface of the component to be coated. This allows for the use of relatively volatile and/or decomposable solid lubricants.

According to another feature, the injection line L is aligned in respect of the spray line S in the direction of injection and spraying at an interception angle $\alpha$ from about 90° to about 30°, preferably from about 90° to about 60°. This allows the use of solid lubricants with a wide range of densities, boiling points and/or decomposition temperatures.

According to a further feature, the thermal spray device is a plasma spray device. This allows compatibility with pre-existing processes and coating compositions for the coating of vehicle components.

The process may further comprise a step of: viii) moving the thermal spray device and the vehicle component relative to each other, while simultaneously maintaining the distance and the positioning of the solid lubricant injection device relative to the thermal spray device. In this way, the coating may further be improved.

According to still another feature, the solid lubricant composition in the arrangement or process comprises at least 70% of solid lubricant by weight, based on the total weight of the solid lubricant composition. The solid lubricant may be any one of graphite, polytetrafluorethylene, $WS_2$, $MoS_2$, hexagonal boron nitride, Ilmenite, $MoSe_2$, $TiO_2$, $Ti_nO_{2n-1}$, $WO_3$, $MoO_3$, double oxides as $NiTiO_3$, $Mo_{0.075}Ti_{0.025}O_2$,β-$NiMoO_4$, or mixtures thereof. This ensures that the coated vehicle component has excellent lubrication properties.

According to yet another feature, the thermal-coating composition in the arrangement or process comprises metal particles and/or ceramic particles. According to one embodiment the metal particles may be stainless steel particles and the ceramic particles can be alumina-zirconia composite particles. This ensures that the coated vehicle component has excellent anti-corrosion and anti-wear properties, as well as excellent lubrication properties.

According to a feature the vehicle component is an internal combustion engine component. It is essential that sufficient lubrication can be provided in components of an internal combustion engine, and the present arrangement is especially suitable for such components.

The present invention further relates to an internal combustion engine comprising a solid lubricant coated component produced according to the above-mentioned process. Such an internal combustion engine has reduced frictional losses when in operation.

The present invention also relates to a vehicle comprising the internal combustion engine as described above. Such a vehicle has improved fuel economy and reduced emissions.

Further aspects, objects and advantages are defined in the detailed description below with reference to the appended drawings.

BRIEF DESCRIPTION OF THE DRAWINGS

For the understanding of the present invention and further objects and advantages of it, the detailed description set out below can be read together with the accompanying drawings, in which the same reference notations denote similar items in the various diagrams, and in which.

DETAILED DESCRIPTION AND EMBODIMENTS

According to the present arrangement and process for thermal spray coating, it is possible to deposit an adequate amount of solid lubricant on a surface to be coated, which is a great advantage for vehicle component surfaces that are in frictional contact, in particular in connection with internal combustion engines, which are incorporated for example in heavy vehicles such as trucks or buses. The vehicle may alternatively be a passenger car. Internal combustion engines may also be used in motorboats, steamers, ferries or ships, industrial engines and/or engine-powered industrial robots, power plants, e.g. an electric power plant provided with a diesel generator, locomotives or other applications. Especially, components in internal combustion engines, such as cylinder liners, are subjected to harsh conditions during operation. The combustion of fuels leads to high temperatures, high pressures and a corrosive environment for these components. At the same time, the movement of reciprocating parts leads to wear and frictional losses in the engine. Therefore it is essential for these components that adequate lubrication is provided.

The present invention provides improved lubrication of these components. It has been realized that by positioning a solid lubricant injection device such that a principal injection direction of the solid lubricant intersects a principal spray direction of a thermal coating at an intersection point intermediate an outlet orifice of a thermal spray device and the surface of the component to be coated, the solid lubricant does not volatilize or decompose substantially before it reaches the target surface while the less-volatile components are deposited in a sufficient amount. Therefore, it is possible to provide solid lubricant coatings for vehicle components, without the need for complex and expensive methods for manufacturing the coating composition. Moreover, it is possible to incorporate advantageous proportions of solid lubricant into a vehicle component surface, without compromising the deposition efficiency of the process. Suitably, the solid lubricant injection device is also directed such that the spray plume from the thermal spray device and the injection plume at least partly coincide when the plumes from the thermal spray device and the injection device hit the surface to be coated.

Figure 1:
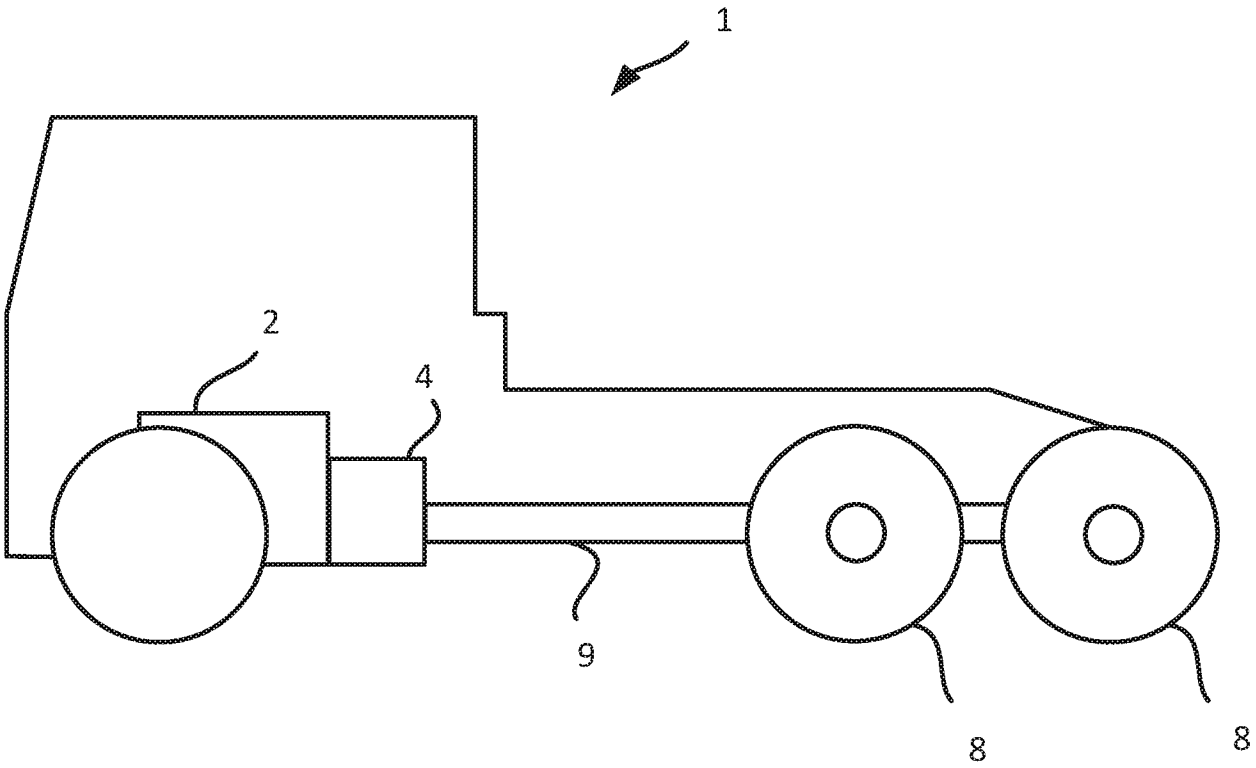
FIG. 1 schematically illustrates a vehicle according to one aspect of the invention.

In FIG. 1 a vehicle 1 has been schematically shown in a side view. The vehicle 1 comprises an internal combustion engine 2. The internal combustion engine 2 is connected to a gearbox 4. The internal combustion engine 2 is suitably a reciprocating engine, such as an Otto or a diesel engine. The gearbox 4 is connected to the driving wheels 8 of the vehicle 1 through an output shaft of the gearbox (4) and a drive shaft (9). The vehicle 1 in FIG. 1 is a truck. At least some of the components of the vehicle, and particularly components of the internal combustion engine 2, are coated by the process and arrangement of the present application. The use of solid lubricant coated components in the vehicle 1, and particularly in the internal combustion engine 2, leads to the vehicle having improved fuel efficiency and reduced emissions.

Figure 2:
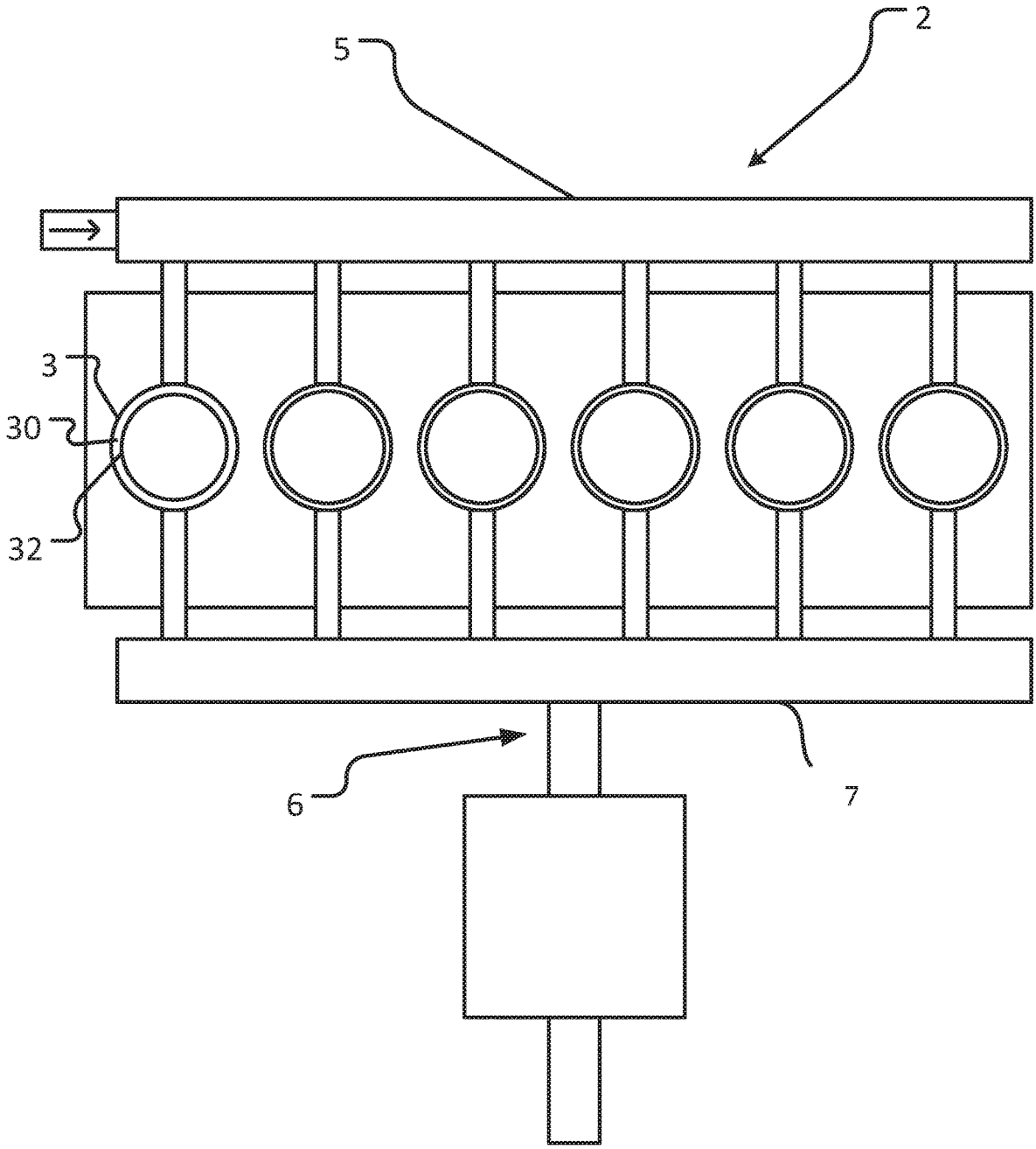
FIG. 2 schematically illustrates an internal combustion engine according to one aspect of the invention.

FIG. 2 schematically shows an example of an internal combustion engine 2. The internal combustion engine has a number of cylinders 3, in this case six cylinders arranged in a straight configuration, but only one is referred to in the figure. Each cylinder 3 is fluidly connected to a fuel system 5 and to a fresh air intake system (not shown), and to an exhaust gas system 6 via an exhaust gas manifold 7. The cylinders 3 are lined with a cylinder liner 30 comprising grey cast iron. The interior surface 31 of the liner 30 is provided with a coating 32 by the process of the present invention. In principal any other component in a vehicle where inter-component friction is an issue may be coated in accordance with the present invention. The use of such coated components leads to reduced frictional losses in the vehicle, especially if the components are poorly lubricated by the conventional liquid lubrication system.

Figure 3:
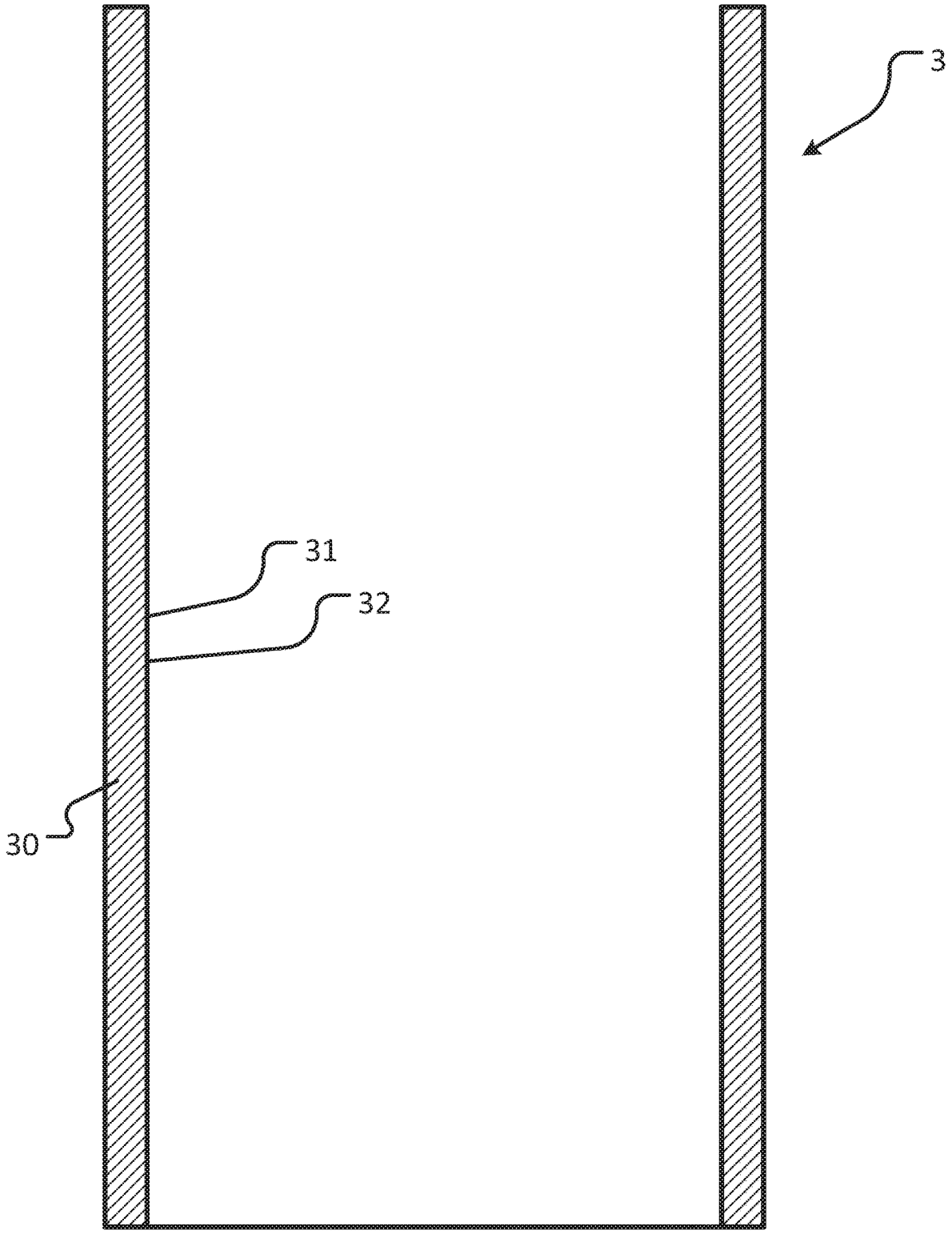
FIG. 3 schematically illustrates a cylinder liner, which is representative of vehicle components to be coated according to one aspect of the invention.

FIG. 3 schematically shows a cylinder 3 with a liner 30 for use in an internal combustion engine. This component is representative of components that can be coated using the arrangement and process of the present invention. However, as mentioned above, in principle any component of a vehicle where inter-component friction is an issue can be coated in accordance with the present invention. Such components include for example transmission components, synchronization rings, clutch discs, gearshift forks, pistons, piston rings, bearings, ball joints, gearwheels, crank pins and crankshafts, and other components are of course possible.

Prior to coating, the surface of the component is suitably cleaned and roughened in order to improve the bonding of the coating particles to the component surface. The cleaning and roughening is performed by methods known in the art.

The present invention is applicable to a variety of thermal spray techniques. The techniques can differ inter alia in the location of the thermal-coating composition inlets, the nature of the thermal-coating composition feed, the composition of the process gas, the method of heating the process gas, the temperature of the spray plume obtained and the velocities of the coating particles in the spray plume. Thermal spray techniques known in the art include atmospheric plasma spraying, High Velocity Oxy-Fuel (HVOF) liquid fuel spraying, HVOF gas fuel spraying, electric arc wire spraying, combustion wire spraying, combustion powder spraying and controlled atmosphere plasma spraying.

Figure 4:
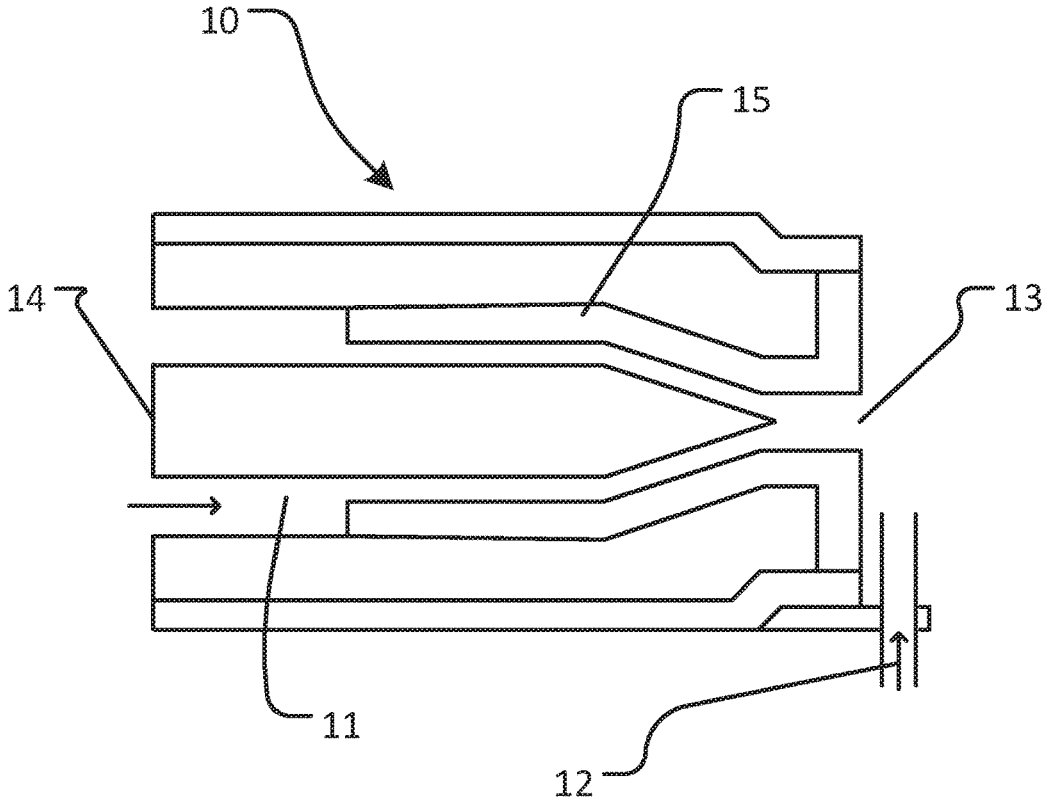
FIG. 4 schematically illustrates a plasma spray device, which is representative of thermal spray devices.

FIG. 4 shows a plasma spray device 10, which is representative for a thermal spray device. The thermal spray device 10 typically comprises at least one process gas inlet 11, a thermal coating composition inlet 12, and an outlet orifice 13. There may be more than one inlet or the inlet may surround the outlet orifice 13. A process gas is fed to the thermal spray device 10 and is heated as described below. At the same time, the thermal-coating composition is fed to the thermal spray device 10 and is heated as described below.

The thermal coating composition is most commonly fed to the thermal spray device as a powder, but may also be fed as a wire (combustion wire spraying). If the thermal coating composition is fed as a powder, a carrier gas such as nitrogen or argon can be used to assist the feeding. Depending on the technique used, the thermal coating composition may be mixed with the process gas either prior to heating or after heating, and either within the interior of the device or in direct proximity to the outlet orifice.

The manner of heating of the process gas and thermal-coating composition differs depending on the thermal spray technique used. In most techniques, the process gas is first heated and this heat is then transferred to the thermal-coating composition, at least partially melting the thermal-coating composition. If the process gas is a fuel/oxidant blend, it is heated by combustion. Fuels known for application in thermal spray coating include acetylene, propane, propylene, hydrogen, natural gas and kerosene. Known oxidants include oxygen and air. The process gas may also be heated by ionization of the process gas, forming a plasma. The process gas may also be heated indirectly by bringing it into contact with a heated thermal coating composition, such as in electric arc wire spray.

A brief outline of the various thermal spray techniques follows.

In the combustion wire spray process a thermal coating composition formed as a wire is fed concentrically through the spray device into an oxygen-fuel flame, where it is melted. The melted material is atomized and directed towards the substrate surface by the addition of a compressed air feed.

The combustion powder spray process is similar to the combustion wire process. However, the thermal-coating composition feed is a powder, meaning that a wider range of thermal-coating compositions can be used, since not all materials can be manufactured in wire form.

In electric arc wire spraying, an arc is formed by the contact of two oppositely charged thermal coating composition feeds formed as wires, leading to melting at the contact location. A compressed air feed then atomizes the melted wire material and directs it towards the substrate.

In HVOF spraying, a supersonic jet of gas and thermal coating composition is formed by the combustion of a liquid or gaseous fuel in oxygen. The coating particle impact velocities on the substrate are much higher than compared to conventional flame spraying, resulting in improved coating characteristics.

The thermal spray device is preferably a plasma spray device.

Returning to FIG. 4, the plasma spraying utilizes a chamber with one or more cathodes 14 (electrodes) and an anode 15 (nozzle). With process gases flowing through the chamber, direct current power is applied to the cathode 14, which arcs to the anode 15. The arc ionizes the gas molecules to form a plasma plume. As the unstable plasma ions recombine back to the gaseous state, a large amount of thermal energy is released.

The thermal-coating composition is fed into the hot process gas plume by a carrier gas, commonly nitrogen or argon. The thermal-coating composition inlet 12 is either integrated into the outlet nozzle or is positioned externally in direct proximity to the outlet orifice 13. The thermal-coating composition is entrained in the process gas plume where it is at least partially melted and propelled towards the target substrate to form the coating.

The process gases typically used are argon, hydrogen, nitrogen and helium, either individually or in mixtures of two, or even three of these gases. The gases used in combination with the current applied to the electrode controls the amount of energy produced. Since gas flows and the applied current can be accurately controlled, reproducible and predictable coating results can be obtained.

The plasma spray process can be performed in an open atmosphere, where it is termed atmospheric plasma spraying (APS), or in a controlled atmosphere, such as under vacuum (VPS) or under low-pressure (LPPS). A controlled atmosphere process results in less oxidation of the coating particles, and thus a higher quality coating, but is significantly more expensive.

In addition, the shape and bore size of the nozzle, the point and angle that the coating material is injected into the plume, as well as the distance of the gun to the target surface are also controlled. This provides a high degree of flexibility to develop reproducible parameters The temperature in the thermal spray plume depends on a number of factors, primary among them being the thermal spray technique used. The plume temperature can range from about 2600° C. for HVOF spraying to 12000-16000° C. for plasma spraying. The coating particles achieve a temperature from about 1200° C. to 2700° C. for single cathode plasma spraying. This is far in excess of the vaporization and/or decomposition temperatures of the most common solid lubricants.

The temperature of the component being coated can be controlled by regulation using a number of parameters in the arrangement, such as the distance d of the plasma gun to the component and the relative motion of the various parts of the arrangement. Cooling air jets focused on the substrate can also be used. By these techniques, the temperature of the substrate can be kept at a controlled temperature in the range of about 40° C. to about 260° C.

Any thermal-coating composition known in the art may be used. The thermal-coating compositions that are suitable depend on the desired properties of the component being coated. For instance, improved thermal, wear and corrosion properties can be obtained. Pure metals, alloys, composites, carbides, ceramics, or mixtures thereof can be used. The thermal-coating compositions are usually provided in powder form with particle sizes preferably in the range of 10-100 μm. However, thermal-coating compositions in the form of wire, e.g. metal wire, may also be used in the present invention.

A preferred thermal-coating composition is SUMEBore F2071 from Oerlikon Metco. This coating consists of a steel comprising 0.4-0.5 wt % C, 0.4-0.8 wt % Mn, 12-14 wt % Cr, 2.0-3.0 wt % Mo and the balance Fe, together with 35 wt % of an alumina-zirconia composite. The metal particles have a diameter of about 5 μm to about 45 μm. The ceramic composite particles have a diameter of about 5 μm to about 38 μm.

The solid lubricant composition is intended for injection into the coating spray plume at a position downstream of the outlet orifice of the thermal spray device, thus reducing the maximum temperatures that the solid lubricant particles are exposed to, as well as reducing the duration of time that the particles are exposed to the plume temperatures.

Solid lubricants suitable for inclusion in the solid lubricant composition include, but are not limited to, graphite, polytetrafluorethylene (PTFE), $WS_2$, $MoS_2$, hexagonal boron nitride (BN), Ilmenite ($FeTiO_3$), $MoSe_2$, $TiO_2$, $Ti_nO_{2n-1}$, $WO^3$, $MoO_3$, double oxides as $NiTiO_3$, $Mo_{0.075}Ti_{0.025}O_2$, β-$NiMoO_4$, or mixtures of one or several of the listed solid lubricants. Other solid lubricants with equal properties could be used. The choice of lubricants for inclusion in the solid lubricant composition is determined by the application and operating conditions of the component to be coated.

As an example, some melting, evaporation and/or decomposition temperatures are listed below for some common solid lubricants useable in the arrangement and process of the invention. For example, graphite vaporizes at about 450° C. at atmospheric pressure. PTFE melts at 327° C. $WS_2$ decomposes at 594° C. in air at atmospheric pressure or at 1250° C. in vacuum. $MoS_2$ decomposes at 316° C. in air at atmospheric pressure or at 1185° C. in vacuum, hexagonal BN decomposes at 1000° C. in air at atmospheric pressure. $MoSe_2$ has a melting point of at least 1150° C., but decomposes at 400° C. in air at atmospheric pressure. Ilmenite has a melting point of 1370° C. $Ti_nO_{2n-1}$ (Magnéli phases) has melting points ranging from 1667-1869° C. $WO_3$ has a melting point of 1473° C. $MoO_3$ has a melting point of 801° C.

The particle sizes of the solid lubricants can be freely chosen, but are preferably in the same region as any metal powder used in the coating, which typically means from about 10 to 100 μm.

The solid lubricant composition may also include minor proportions of further constituents to be incorporated into the final coated layer, especially constituents that are not typically suitable for inclusion in the thermal-coating composition, i.e. constituents that are volatile or subject to decomposition at the temperatures achieved in the plume. Such constituents may comprise at most up to 30 weight percent of the total weight of the solid lubricant composition. Suitably, the amount is less than 20 weight percent, preferably less than 10% and most preferably less than 5%. According to one aspect, the solid lubricant composition is free or substantially free of further constituents. Consequently, the solid lubricant composition comprises from 70-100% solid lubricant by weight, based on the total weight of the solid lubricant composition. Thereby, advantageous and adequate amounts of solid lubricant can be deposited on a surface to be coated. The higher the amount solid lubricant, the better the deposition, and therefore the the solid lubricant composition preferably comprises from 95-100% solid lubricant by weight.

Figure 5:
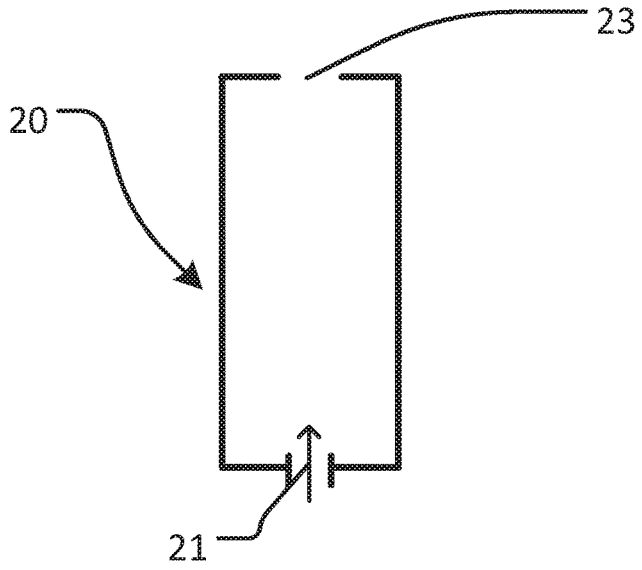
FIG. 5 schematically illustrates a solid lubricant injection device.

FIG. 5 shows schematically an example of a solid lubricant injection device 20 useable in the arrangement or process of the present invention. The solid lubricant injection device 20 comprises a fluidized solid lubricant inlet 21 and an outlet orifice 23. A fluidized solid lubricant composition, comprising solid lubricant composition and carrier gas, is fed to the injection device 20 from a powder feeder as known in the art, e.g. a gravitational or rotating disc powder feeder. The carrier gas is commonly nitrogen or argon. The solid lubricant injection device 20 is arranged to be held in position relative to the thermal spray device 10 using any means known in the art, such as a fixture, jig, scaffold, or boom arm. The solid lubricant injection device 20 may be similar in construction to a typical inlet for a powder feed material known in the art. It may constitute an entirely separate device from the thermal spray device 10, or it may be partially or fully integrated with the thermal spray device 10. For instance, it may share a carrier gas source or powder feeder with the thermal spray device 10. It may also be held in position relative to the thermal spray device 10 by direct or indirect attachment to the thermal spray device 10. In any case, the solid lubricant injection device 20 can be positioned by translation and rotation independently of the thermal spray device 10 and its corresponding thermal-coating composition inlet 12.

Figure 6:
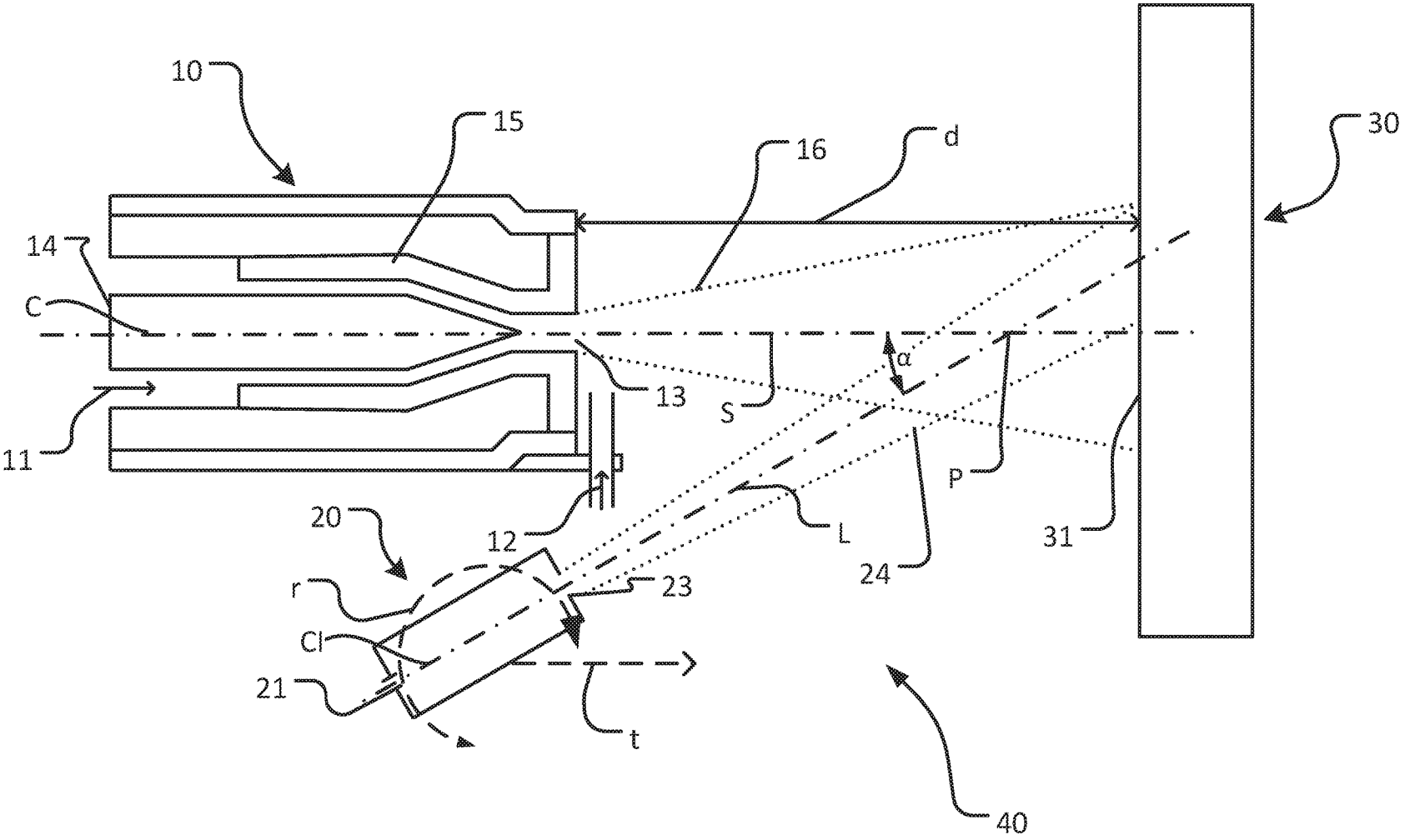
FIG. 6 schematically illustrates a thermal coating arrangement according to one aspect of the present invention.

FIG. 6 shows an example of a coating arrangement in accordance with the present invention. The arrangement comprises a thermal spray device 10, a solid lubricant injection device 20, and a vehicle component 30 to be coated.

The thermal spray device 10 comprises a process gas inlet 11, through which a carrier gas, commonly nitrogen or argon, is fed to the device. The thermal spray device further comprises a thermal-coating composition inlet 12, through which the thermal-coating composition is fed to the device 10. The thermal spray device 10 also comprises at an outlet end of the device, which includes an outlet orifice 13 through which the hot process gas is fed. The thermal spray device 10 has a spray direction along a spray line S corresponding to a central axis of a spray plume 16. In this way, a primary spray direction is defined, meaning that the spray plume has a main direction. Further, the spray line S is aligned with a central axis line C of the thermal spray device 10. The central axis line C passes through a center of the outlet orifice. By center is meant a middle point of the outlet orifice in a plane perpendicular to the central axis of the thermal spray device.

The solid lubricant injection device 20 comprises a fluidized solid lubricant inlet 21 through which the solid lubricant is fed to the device 20. The solid lubricant injection device 20 further comprises an outlet orifice 23, through which the solid lubricant is injected. The solid lubricant injection device 20 has an injection direction along an injection line L that corresponds to a central axis of an injection plume 24. The injection line L is aligned with a central axis line CI of the solid lubricant injection device 20. As in connection with the thermal spray device 10, the central axis line CI suitably passes through a center of the outlet orifice 24. By center is meant a middle point of the outlet orifice 24 in a plane perpendicular to the central axis CI of the injection device.

The vehicle component 30 to be coated has a surface 31 arranged at a distance d from the outlet orifice 13 of the thermal spray device 10 along the spray line (S). The solid lubricant injection device 20 is arranged in a position relative to the thermal spray device 10 such that the injection line L intersects the spray line S at an intersection point P. The intersection point P is intermediate the outlet orifice 13 of the thermal spray device 10 and the surface 31 of the component to be coated. Directing and positioning of the device 20 such that the spray lines S and L intersect can be achieved either by lateral translation of the solid lubricant injection device 20 towards the surface 31 of the component to be coated (arrow t), or by rotation of the solid lubricant injection device 20 to give an acute interception angle $\alpha$ (arrow r), or a combination of both. The solid lubricant injection device 20 is suitably directed such that the spray plume 16 from the thermal spray device 20 and the injection plume 24 at least partly coincide when the plumes 16 and 24 hit the surface 31 to be coated.

Thus, in order to reduce vaporization and/or decomposition of the solid lubricant composition, the solid lubricant composition is injected into the coating spray plume at a position intermediate the outlet orifice 13 of the thermal spray device 10 and the surface 31 of the component to be coated, i.e. it is injected downstream of the outlet orifice 13 of the thermal spray device 10. This means that the solid lubricant composition does not come into direct contact with the pure plasma plume. The pure plasma plume is obtained by the thermal spray device in which direct current is applied to the cathode, which arcs the anode while the process gases flow through the chamber, and wherein the arc ionizes the gas molecules to form a plasma plume.

In contrast to the thermal coating composition, which is fed into the hot process gas plume by a carrier gas, the solid lubricant composition is arranged to by-pass the thermal spray device. Thus, the solid lubricant composition is injected to the gas plume that already contains the thermal coating composition. Since it is injected into the coating spray plume at a position intermediate the outlet orifice of the thermal spray device and the surface of the component to be coated, the temperature of the coating spray plume is close to or lower than the vaporization and/or decomposition temperature of the most common solid lubricants. Also since the time period the solid lubricant is in contact with the coating spray plume is decreased, less lubricant vaporizes and/or decomposes compared to the situation where the solid lubricant is fed to the hot process gas plume simultaneously with the coating composition.

The optimal interception point P and interception angle $\alpha$ obtained by translation and/or rotation of the solid lubricant injection device 20 relative to the thermal spray device 10 depends on a number of factors. These include the relative densities of the solid lubricant particles compared to the coating particles, the process gas flow velocity, the injection velocities of the solid lubricant particles and the plume temperature profile and the thermal properties of the solid lubricants (melting, boiling and decomposition temperatures).

Satisfactory values for P and a for any given combination of thermal-coating composition and solid lubricant composition can be determined either empirically or by using computational fluid dynamics. Typically, the interception point P should be at a distance of less than 0.75 d from the surface 31 of the component 30 to be coated, preferably less than 0.5 d, i.e. counted from the surface of the component to be coated towards the orifice 13. In some cases the interception point P can even be directly proximate to the surface 31. The interception angle α typically is preferably up to or less than 90° to about 30°, preferably from about 90° to about 60°, wherein the injection line L is aligned in respect of the spray line S in the direction of injection.

Satisfactory values are those that provide uniform high-quality coated surfaces while at the same time providing increased deposition efficiency of the solid lubricant, as compared to where the solid lubricant is applied as a constituent of the thermal-coating composition using a conventional thermal spray process.

Figure 7:
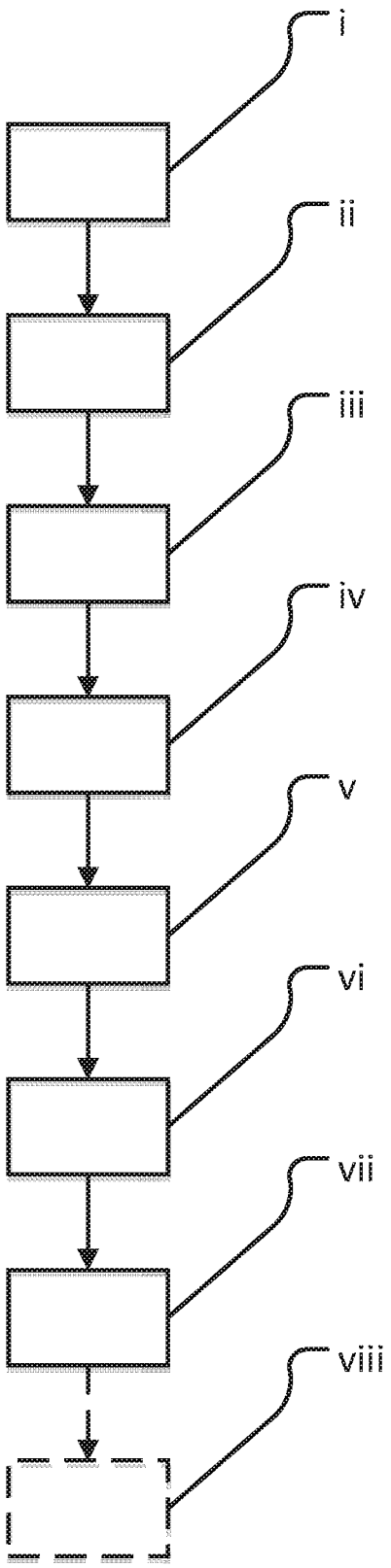
FIG. 7 shows a process flow chart in accordance with one aspect of the present invention.

Once satisfactory parameters have been established, the coating process can be performed. A process chart showing the various stages of the coating process is shown in FIG. 7.

The coating process comprises the following steps:

i) providing a thermal spray device 10, as previously described;

ii) providing a solid lubricant injection device 20, as previously described;

iii) providing a vehicle component 30 to be coated, as previously described;

iv) arranging the thermal spray device 10 and the vehicle component 30 such that the vehicle component 30 has a surface 31 at a distance d from the outlet orifice 13 of the thermal spray device 10 along the spray line S;

v) positioning the solid lubricant injection device 20 such that the injection line L intersects the spray line S at an intersection point P intermediate the outlet orifice 13 of the thermal spray device and the surface 31 of the component to be coated;

The process steps until step v) thus constitute forming the coating arrangement as previously described. The order that the steps are performed in is non-essential, and various modifications are apparent to the person skilled in the art. For example, step v) may be performed prior to steps iii) and iv). A number of steps may also be performed concurrently. The coating process continues:

vi) feeding a process gas and a thermal-coating composition to the thermal spray device 10 and operating the thermal spray device 10, thereby forming a coating spray plume that is propelled towards the surface 31 of the component to be coated, the coating spray plume 16 comprising process gas and at least partially molten thermal-coating composition;

vii) feeding a fluidized solid lubricant composition to the solid lubricant injection device 20 and operating the solid lubricant injection device 20, thereby injecting a solid lubricant composition in an injection direction L into the coating spray plume 16;

Again, the exact order of the steps is non-essential and they may advantageously be performed concurrently.

Depending on the area of the component surface to be coated, a further step may be required:

viii) moving the thermal spray device 10 and the vehicle component 30 relative to each other, while simultaneously maintaining the distance d and the positioning of the solid lubricant injection device 20 relative to the thermal spray device 10.

This step allows for the coating of surfaces with areas exceeding the size of the impingement area of the thermal spray device 10. The relative movement can be achieved by moving the thermal spray device 10 and solid lubricant injection device 20 relative to a stationary component 30 being coated. Alternatively, the thermal spray device 10 and solid lubricant injector 20 can be held stationary and the component 30 can be moved using, for example, a jig, turntable, or robot arm.

By using a suitable interception point P and interception angle α, the maximum temperatures that the solid lubricant particles are exposed to in the plasma plume are decreased. Also, the residence time of the solid lubricant particles in the plasma plume is decreased. Thus, by choosing suitable parameters, the vaporization and decomposition of the solid lubricant can be avoided, while optimal conditions for the thermal-coating composition are maintained.

A vehicle component 30 coated by the above process has a uniform high-quality coated surface 31 with a higher proportion of incorporated solid lubricant as compared to where the solid lubricant is applied as a constituent of the thermal-coating composition using a conventional thermal spray process.

The coating produced by the above process comprises the constituents of the thermal-coating composition together with the constituents of the solid lubricant composition. The coating can, for example, comprise metal and/or ceramic materials, together with solid lubricant. The proportion of solid lubricant present in the coating produced by the above process can be chosen as necessary for each component to be coated, but is suitably from about 5 weight % to about 70 weight % of the final coating. The thickness of the coating produced can be chosen as necessary for each component to be coated, but is suitably from about 0.05 mm to about 5 mm.

The components and features specified above may within the framework of the invention defined in the appended claims be combined between different embodiments specified.

The invention claimed is:

1. An arrangement for coating a vehicle component comprising:

a) a thermal spray device comprising a process gas inlet that receives a process gas, a thermal-coating composition inlet that receives a thermal coating composition, and a first outlet orifice for the process gas and also for the thermal coating composition;

b) the thermal spray device having a spray direction along a spray line corresponding to a central axis of a spray plume from the first outlet orifice, the spray line being aligned with a central axis line passing through a center of the first outlet orifice of the thermal spray device;

c) a solid lubricant injection device comprising a fluidized solid lubricant inlet and a second outlet orifice from the solid lubricant injection device, the solid lubricant injection device having an injection direction along an injection line corresponding to a central axis of an injection plume from the second outlet orifice, the injection line being aligned with a central axis line of the solid lubricant injection device; and d) a vehicle component to be coated, having a surface arranged at a distance from the first outlet orifice of the thermal spray device along the spray line;

e) wherein the solid lubricant injection device is positioned such that the injection line intersects the spray line at an intersection point, which is intermediate the first outlet orifice of the thermal spray device and the surface of the component to be coated, and wherein the solid lubricant injection device is translatable and rotatable relative to the thermal spray device to permit repositioning of the intersection point.

2. An arrangement according to claim 1, wherein the solid lubricant injection device is separate from the thermal spray device.

3. An arrangement according to claim 1, wherein the solid lubricant injection device is integrated with the thermal spray device.

4. An arrangement according to claim 1, wherein the intersection point of the injection line and the spray line is at a distance of less than 0.75d from the surface of the component to be coated.

5. An arrangement according to claim 1, wherein the injection line is aligned in respect of the spray line in a direction of injection and configured to spray at an interception angle from about 90° to about 30°.

6. An arrangement according to claim 1, wherein the thermal spray device is a plasma spray device.

7. An arrangement according to claim 1, wherein the intersection point of the injection line and the spray line is at a distance of less than 0.5d from the surface of the component to be coated.

8. An arrangement for coating a vehicle component comprising:

a) a thermal spray device comprising a process gas inlet that receives a process gas, a thermal-coating composition inlet that receives a thermal coating composition, and a first outlet orifice for the process gas and also for the thermal coating composition;

b) the thermal spray device having a spray direction along a spray line corresponding to a central axis of a spray plume from the first outlet orifice, the spray line being aligned with a central axis line passing through a center of the first outlet orifice of the thermal spray device;

c) a solid lubricant injection device comprising a fluidized solid lubricant inlet and a second outlet orifice from the solid lubricant injection device, the solid lubricant injection device having an injection direction along an injection line corresponding to a central axis of an injection plume from the second outlet orifice, the injection line being aligned with a central axis line of the solid lubricant injection device; and d) wherein the solid lubricant injection device is positioned such that the injection line intersects the spray line at an intersection point, which is intermediate the first outlet orifice of the thermal spray device and the surface of a component to be coated, and wherein the solid lubricant injection device is translatable and rotatable relative to the thermal spray device to permit repositioning of the intersection point.

9. An arrangement according to claim 1, wherein the solid lubricant injection device is positioned so that, at the intersection point, a temperature of the spray plume is lower than a vaporization or a decomposition temperature of the solid lubricant.

10. An arrangement according to claim 8, wherein the solid lubricant injection device is positioned so that, at the intersection point, a temperature of the spray plume is lower than a vaporization or a decomposition temperature of the solid lubricant.

11. An arrangement according to claim 1, wherein the solid lubricant injection device is positioned so that the injection plume is contained within the spray plume at the surface of the component.

12. An arrangement according to claim 8, wherein the solid lubricant injection device is positioned so that the injection plume is contained within the spray plume at the surface of the component.

* * * * *